US011443686B2

(12) United States Patent
Charbonnier et al.

(10) Patent No.: US 11,443,686 B2
(45) Date of Patent: Sep. 13, 2022

(54) DISPLAY SCREEN HAVING LIGHT-EMITTING DIODES

(71) Applicant: Aledia, Grenoble (FR)

(72) Inventors: Matthieu Charbonnier, Fontaine (FR); Frédéric Mercier, Saint Nicolas de Macherin (FR)

(73) Assignee: Aledia, Grenoble (FR)

( * ) Notice: Subject to any disclaimer, the term of this patent is extended or adjusted under 35 U.S.C. 154(b) by 0 days.

(21) Appl. No.: 16/766,636

(22) PCT Filed: Dec. 6, 2018

(86) PCT No.: PCT/EP2018/083891

§ 371 (c)(1),
(2) Date: May 22, 2020

(87) PCT Pub. No.: WO2019/129474

PCT Pub. Date: Jul. 4, 2019

(65) Prior Publication Data

US 2020/0365075 A1 Nov. 19, 2020

(30) Foreign Application Priority Data

Dec. 28, 2017 (FR) ..... 1763313

(51) Int. Cl.
*G09G 3/32* (2016.01)
*G09G 3/20* (2006.01)
(Continued)

(52) U.S. Cl.
CPC ..... *G09G 3/32* (2013.01); *G09G 3/2014* (2013.01); *G09G 3/3233* (2013.01);
(Continued)

(58) Field of Classification Search
CPC ..... G09G 3/32; G09G 2300/0861; G09G 2320/064; G09G 3/3291;
(Continued)

(56) References Cited

U.S. PATENT DOCUMENTS 7,187,355 B2 3/2007 Tam et al.
2004/0263095 A1 12/2004 Min et al.
(Continued)

OTHER PUBLICATIONS

International Search Report and Written Opinion for International Application No. PCT/EP2018/083891, dated Feb. 12, 2019.
(Continued)

*Primary Examiner* — Patrick N Edouard
*Assistant Examiner* — Joseph P Fox
(74) *Attorney, Agent, or Firm* — Wolf, Greenfield & Sacks, P.C.

(57) ABSTRACT

A display screen including display circuits, each display circuit including a light-emitting diode, a controllable current source powering the light-emitting diode, and a control circuit capable of supplying a pulse-width modulated signal for controlling the current source from a periodic signal. The display screen further includes first electrodes coupled to the control circuits, a circuit for supplying a selection signal successively on each first electrode, and an oscillating circuit or oscillating circuits capable of supplying the periodic signals, the periodic signals being non-synchronous with the display circuit selection signals.

7 Claims, 4 Drawing Sheets

(51) Int. Cl.
*G09G 3/3233* (2016.01)
*G09G 3/3291* (2016.01)

(52) U.S. Cl.
CPC ... *G09G 3/3291* (2013.01); *G09G 2300/0809* (2013.01); *G09G 2300/0842* (2013.01); *G09G 2300/0861* (2013.01); *G09G 2320/064* (2013.01); *G09G 2330/025* (2013.01)

(58) Field of Classification Search
CPC ... G09G 2300/0809; G09G 2300/0842; G09G 2330/025; G09G 3/3233; G09G 3/2014
See application file for complete search history.

(56) References Cited

U.S. PATENT DOCUMENTS

2005/0067968 A1 3/2005 Yamashita
2008/0100224 A1* 5/2008 Felder ..... H05B 45/10 315/151
2010/0245401 A1 9/2010 Smith et al.
2011/0037396 A1* 2/2011 Chien ..... H05B 45/37 315/185 R
2014/0292745 A1 10/2014 Kikuchi et al.
2017/0039935 A1 2/2017 Yang et al.

OTHER PUBLICATIONS

Preliminary Search Report for French Application No. 1763313, dated May 14, 2018.
PCT/EP2018/083891, Feb. 12, 2019, International Search Report and Written Opinion.
FR1763313, May 14, 2018, Preliminary Search Report.
International Preliminary Report on Patentability for International Application No. PCT/EP2018/083891, dated Jul. 9, 2020.

* cited by examiner

DISPLAY SCREEN HAVING LIGHT-EMITTING DIODES

This application is a national stage filing under 35 U.S.C. § 371 of International Patent Application Serial No. PCT/EP2018/083891, filed Dec. 6, 2018, which claims priority to French patent application FR17/63313. The contents of these applications are incorporated herein by reference in their entirety.

BACKGROUND

The present disclosure relates to a display screen having its display pixels comprising light-emitting diodes, whatever their type of technology (2D, 3D light-emitting diode, organic light-emitting diode, etc.).

DISCUSSION OF THE RELATED ART

The display pixels of a display screen comprising light-emitting diodes may comprise, for each display pixel, a circuit for controlling the light-emitting diode or the light-emitting diodes of the display pixel.

It is known to control a light-emitting diode by pulse-width modulation, also called PWM. This type of control comprises conducting successive constant current pulses through the light-emitting diode, the pulses being cyclically repeated, the duty cycle determining the light intensity emitted by the light-emitting diode. Such a control advantageously enables to operate the light-emitting diode at its optimum operating point where the efficiency of the light-emitting diode, equal to the ratio of the light power emitted by the light-emitting diode to the electric power consumed by the light-emitting diode, is maximum.

The current tendency is to decrease the dimensions of the display pixels of display screens comprising light-emitting diodes. This causes a decrease in the space available to form the display pixel control circuits. A disadvantage is that control circuits implementing a pulse-width modulation generally occupy more space than other types of control circuits.

SUMMARY

An object of an embodiment is to provide a display screen comprising light-emitting diodes overcoming all or part of the disadvantages of existing display screens comprising light-emitting diodes.

Another object of an embodiment is for the control circuits of the display screen to implement a pulse-width modulation.

Another object of an embodiment is for the display pixels to have dimensions smaller than 200 μm.

Thus, an embodiment provides a display screen comprising display circuits, each display circuit comprising a light-emitting diode, a controllable current source powering the light-emitting diode, and a control circuit capable of supplying a pulse-width modulated signal for controlling the current source from a periodic signal, the display screen further comprising first electrodes coupled to the control circuits, a circuit for supplying a selecting signal successively on each first electrode, and an oscillating circuit or oscillating circuits capable of supplying the periodic signals, the periodic signals being non-synchronous with the display circuit selection signals.

According to an embodiment, the display screen comprises at least two oscillating circuits capable of supplying the periodic signals.

According to an embodiment, the at least two oscillating circuits are capable of supplying the non-synchronous periodic signals.

According to an embodiment, each of said at least two oscillating circuits is coupled to at least two of said control circuits.

According to an embodiment, each of said at least two oscillating circuits is coupled to at least ten of said control circuits.

According to an embodiment, the screen comprises at least one thousand display circuits and each of said at least two oscillating circuits is coupled to less than one hundred of said control circuits.

According to an embodiment, the screen further comprises second electrodes coupled to the control circuits and a circuit for supplying data signals on the second electrodes and the circuit for controlling each display circuit comprises a circuit for storing the data signal received by the control circuit and a circuit for comparing the data signal and the periodic signal capable of supplying the pulse-width modulated control signal.

According to an embodiment, the frequency of each periodic signal is greater than twice the frequency of the selection signal on one of the first electrodes.

According to an embodiment, the frequency of each periodic signal is greater than ten times the frequency of the selection signal on one of the first electrodes.

According to an embodiment, the frequency of each periodic signal is smaller than 1 MHz.

BRIEF DESCRIPTION OF THE DRAWINGS

The foregoing and other features and advantages will be discussed in detail in the following non-limiting description of specific embodiments in connection with the accompanying drawings, among which.

DETAILED DESCRIPTION

Figure 1:
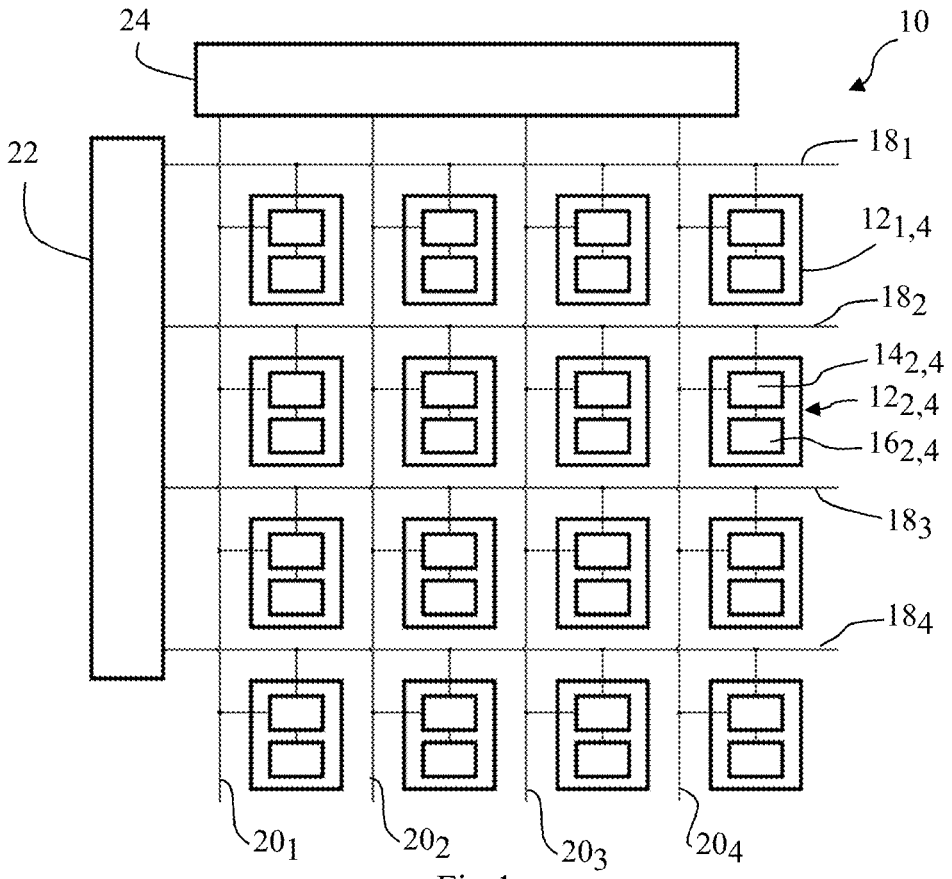
FIG. 1 partially and schematically shows an embodiment of a display screen.

The same elements have been designated with the same reference numerals in the various drawings and, further, the various drawings are not to scale. For clarity, only those steps and elements which are useful to the understanding of the described embodiments have been shown and are detailed. The terms "approximately", "substantially", "about", and "in the order of" are used herein to designate a tolerance of plus or minus 10%, preferably of plus or minus 5%, of the value in question.

Further, a signal which alternates between a first constant state, for example, a low state, noted "0", and a second constant state, for example, a high state, noted "1", is called a "binary signal". The high and low states of different binary signals of a same electronic circuit may be different. In particular, the binary signals may correspond to voltages or to currents which may not be perfectly constant in the high or low state. Further, in the following description, the source and the drain of a MOS transistor are called "power terminals" of the insulated gate field-effect transistor, or MOS transistor. Further, in the present description, the term "coupled" or "linked" will be used to designate either a direct electric connection (then meaning "connected") or a connection via one or a plurality of intermediate components (resistor, capacitor, etc.). Further, a first binary signal is called "synchronous" with a second binary signal when the rising and/or falling edges of the first signal occur at the same time as the rising and/or falling edges of the second signal or occur at regular intervals with respect to the rising and/or falling edges of the second signal. In particular, synchronous binary signals derive from a common clock. Conversely, first and second binary signals are called "asynchronous" or "non-synchronous" when the rising and/or falling edges of the first signal occur neither at the same time as the rising and/or falling edges of the second signal nor at regular intervals with respect to the rising and/or falling edges of the second signal. In particular, asynchronous binary signals do not derive from a same clock.

A pixel of an image corresponds to the unit element of the image displayed by a display screen. When the display screen is a color image display screen, it generally comprises, for the display of each image pixel, at least three emission and/or light intensity regulation components, also called display sub-pixels, which each emit a light radiation substantially in a single color (for example, red, green, or blue). The superposition of the radiations emitted by the three display sub-pixels provides the observer with the colored sensation corresponding to the pixel of the displayed image. When the display screen is a monochrome image display screen, the display screen generally comprises a single light source for the display of each pixel of the image.

FIG. 1 partially and schematically shows an embodiment of a display screen 10. Display screen 10 comprises display circuits $\mathbf{12}_{i,j}$ for example arranged in M rows and in N columns, M being an integer varying from 1 to 16,000 and N being an integer varying from 1 to 8,000, i being an integer varying from 1 to M and j being an integer varying from 1 to N. As an example, in FIG. 1, M and N are equal to 4. Each display circuit $\mathbf{12}_{i,j}$ comprises a control circuit $\mathbf{14}_{i,j}$ and a display sub-pixel $\mathbf{16}_{i,j}$. Each display sub-pixel $\mathbf{16}_{i,j}$ comprises at least one light-emitting diode, not shown.

For each row, the control circuits $\mathbf{14}_{i,j}$ of the display circuits $\mathbf{12}_{i,j}$ in the row are coupled to a row electrode $\mathbf{18}_i$. For each column, the control circuits $\mathbf{14}_{i,j}$ of the display circuits $\mathbf{12}_{i,j}$ of the column are coupled to a column electrode $\mathbf{20}_j$.

Display screen 10 comprises a selection circuit 22 coupled to row electrodes $\mathbf{18}_i$ and capable of supplying a selection signal $\mathrm{VSelect}_i$ on each row electrode $\mathbf{18}_i$. Display screen 10 comprises a control circuit 24 coupled to column electrodes $\mathbf{20}_j$ and capable of supplying a data signal $\mathrm{Data}_{i,j}$ on each column electrode $\mathbf{20}_j$.

Figure 2:
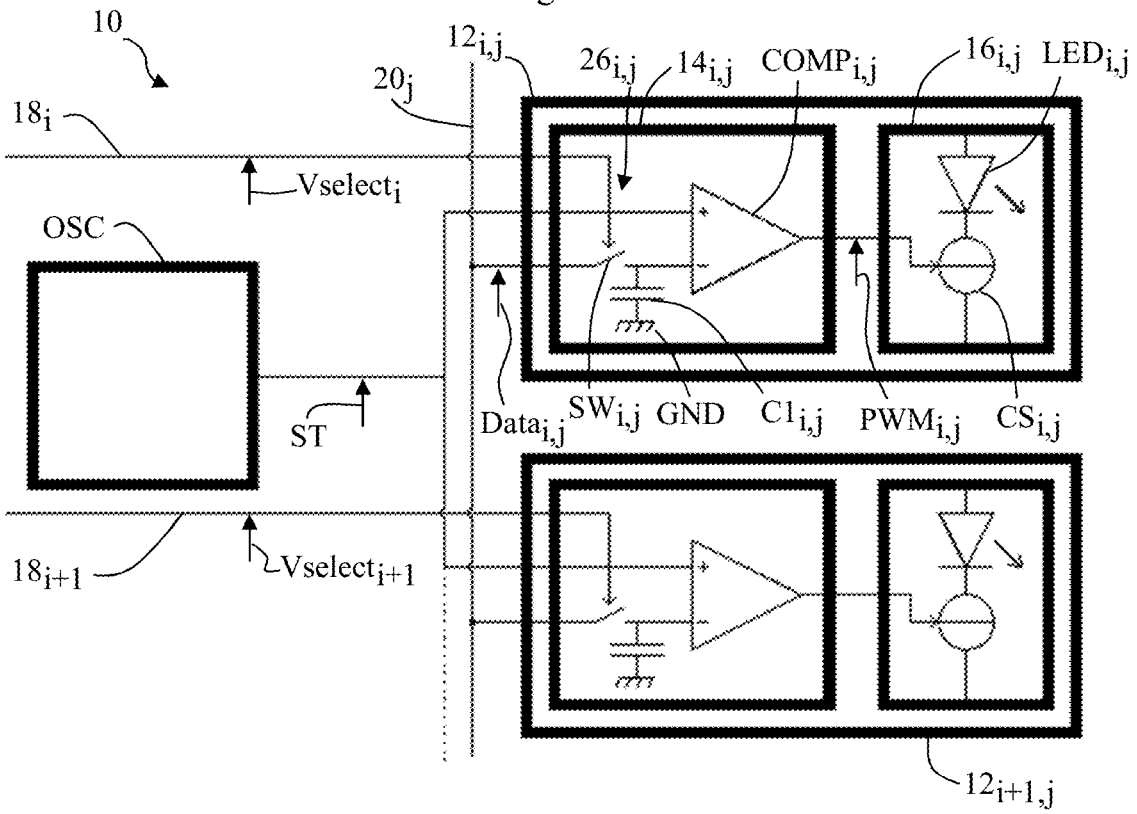
FIG. 2 shows a more detailed embodiment of a portion of the display screen of FIG. 1.

FIG. 2 shows a more detailed embodiment of two display circuits $\mathbf{12}_{i,j}$ and $\mathbf{12}_{i+1,j}$ of display screen 10.

According to an embodiment, display screen 10 comprises an oscillating circuit OSC for supplying an oscillating and periodic signal ST coupled to display circuits $\mathbf{12}_{i,j}$ and $\mathbf{12}_{i+1,j}$. Each display sub-pixel $\mathbf{16}_{i,j}$ comprises a light-emitting diode $\mathrm{LED}_{i,j}$ series-coupled to a controllable current source $\mathrm{CS}_{i,j}$. Each control circuit $\mathbf{14}_{i,j}$ comprises a storage circuit $\mathbf{26}_{i,j}$ coupled to row electrode $\mathbf{18}_i$ and to column electrode $\mathbf{20}_j$. Storage circuit $\mathbf{26}_{i,j}$ is controlled by signal $\mathrm{VSelect}_i$ supplied by row electrode $\mathbf{18}_i$ and is capable of storing the signal $\mathrm{Data}_{i,j}$ supplied by column electrode $\mathbf{20}_j$. According to an embodiment, storage circuit $\mathbf{26}_{i,j}$ comprises a switch $\mathrm{SW}_{i,j}$ controlled by signal $\mathrm{VSelect}_i$ and a capacitor $\mathrm{C1}_{i,j}$. The first terminal of switch $\mathrm{SW}_{i,j}$ is coupled to column electrode $\mathbf{20}_j$ and the second terminal of switch $\mathrm{SW}_{i,j}$ is coupled to the first electrode of capacitor $\mathrm{C1}_{i,j}$, the second electrode of capacitor $\mathrm{C1}_{i,j}$ being coupled to a source GND of a low reference potential, for example, the ground. Each control circuit $\mathbf{14}_{i,j}$ further comprises a comparison circuit $\mathrm{COMP}_{i,j}$ coupled at a first input (+) to oscillating circuit OSC and coupled at a second input (−) to the first electrode of capacitor $\mathrm{C1}_{i,j}$. Comparison circuit $\mathrm{COMP}_{i,j}$ supplies a signal $\mathrm{PWM}_{i,j}$ for controlling current source $\mathrm{CS}_{i,j}$.

An embodiment of an operating method of display screen 10 will now be described. Signal $\mathrm{Vselect}_i$ is a binary signal. When signal $\mathrm{Vselect}_i$ is in a first state, for example the low state, switch $\mathrm{SW}_{i,j}$ is off and when signal $\mathrm{Vselect}_i$ is in a second state, for example, the high state, switch $\mathrm{SW}_{i,j}$ is on. Signals $\mathrm{Data}_{i,j}$ are analog signals representative of the desired light intensities to be emitted by light-emitting diodes $\mathrm{LED}_{i,j}$. When switch $\mathrm{SW}_{i,j}$ is turned on, the voltage across capacitor $\mathrm{C1}_{i,j}$ becomes substantially equal to signal $\mathrm{Data}_{i,j}$. Signal $\mathrm{PWM}_{i,j}$ is a binary signal which depends on the comparison between signal ST and the voltage across capacitor $\mathrm{C1}_{i,j}$, that is, signal $\mathrm{Data}_{i,j}$. As an example, signal $\mathrm{PWM}_{i,j}$ is in a first state, for example, the high state, when signal ST is greater than signal $\mathrm{Data}_{i,j}$ and signal $\mathrm{PWM}_{i,j}$ is in a second state, for example, the low state, when signal ST is smaller than signal $\mathrm{Data}_{i,j}$. Preferably, signal ST is a periodic signal which, over each period, continuously increases or continuously decreases substantially over the entire period. As an example, signal ST is a sawtooth signal which, over each period, increases or decreases with a substantially constant slope. The obtained signal $\mathrm{PWM}_{i,j}$ then is a pulse-width modulated cyclic signal, the duration of signal $\mathrm{PWM}_{i,j}$ in the high state over one cycle being proportional to signal $\mathrm{Data}_{i,j}$.

Current source $\mathrm{CS}_{i,j}$ is controlled by signal $\mathrm{PWM}_{i,j}$. As an example, current source $\mathrm{CS}_{i,j}$ is activated, that is, it powers light-emitting diode $\mathrm{LED}_{i,j}$ with current, when signal $\mathrm{PWM}_{i,j}$ is in the first state, for example, the high state, and current source $\mathrm{CS}_{i,j}$ is deactivated, that is, light-emitting diode $\mathrm{LED}_{i,j}$ is not crossed by a current, when signal $\mathrm{PWM}_{i,j}$ is in the second state, for example, the low state. When it is activated, the current supplied by current source $\mathrm{CS}_{i,j}$ is preferably substantially constant and equal to the current for which the efficiency of the light-emitting diode $\mathrm{LED}_{i,j}$ is maximum. Light-emitting diode $\mathrm{LED}_{i,j}$ is thus either powered at constant current or turned off. A control of light-emitting diode $\mathrm{LED}_{i,j}$ by pulse-width modulation is thus obtained.

In the embodiment illustrated in FIG. 2, oscillating circuit OSC is as an example coupled to two display circuits $\mathbf{12}_{i,j}$ and $\mathbf{12}_{i+1,j}$. Generally, display screen 10 may comprise one or a plurality of oscillating circuits OSC, each oscillating circuit OSC being coupled to a number K of display circuits $\mathbf{12}_{i,j}$, K being an integer in the range from 1 to N*M, preferably varying from 1 to 8,000*4,000. The case where K is equal to 1 corresponds to the case where display screen 10 comprises an oscillating circuit OSC for each display circuit $\mathbf{12}_{i,j}$ and the case where K is equal to N*M corresponds to the case where display screen 10 comprises a single oscillating circuit OSC for all the display circuits $\mathbf{12}_{i,j}$.

According to an embodiment, the rows of display sub-pixels are successively activated. Signals $Vselect_i$ to $VSelect_M$ are then successively set to the high state for a duration ΔT, signals $Vselect_1$ to $VSelect_{i-1}$ and $Vselect_{i+1}$ to $VSelect_M$ being in the low state when signal $Vselect_i$ is in the high state. Call F the display screen refreshment frequency. Frequency F is equal to 1/ΔT. As an example, frequency F varies from 25 Hz to 120 Hz. Frequency F' of signal ST is greater than 2 times frequency F, preferably greater than 10 times frequency F, more preferably greater than 100 times frequency F. As an example, frequency F' is greater than 1 kHz, preferably greater than 10 kHz, more preferably greater than 100 kHz. Frequency F' of signal ST is preferably smaller than 1 MHz. Advantageously, the structure of oscillating circuit OSC may then be simple. Further, when oscillating circuit OSC uses switches, the losses due to the switchings of the switches are low.

According to an embodiment, signal ST is not synchronous with respect to signals $VSelect_i$ and $Data_{i,j}$. This means that the beginning of each period of signal ST is not synchronous with the times at which signals $Vselect_i$ switch state. Further, when a plurality of oscillating circuits OSC are present, the signals ST supplied by oscillating circuits OSC are preferably not synchronous. The design of display screen 10 is then simplified since signals ST do not have to be maintained synchronous with one another and with signals $VSelect_i$ and $Data_{i,j}$. Further, current inrushes during the operation of display screen 10 are advantageously spread over time.

Further, the number of conductive tracks coupling oscillating circuit OSC and each associated control circuit $\mathbf{14}_{i,j}$ is decreased. Further, when display screen 10 comprises a plurality of oscillating circuits OSC, the distance traveled by signal ST between each oscillating circuit OSC and the display circuits $\mathbf{12}_{i,j}$ to which oscillating circuit OSC is coupled can be decreased with respect to the case where a clock signal should be supplied to each display circuit $\mathbf{12}_{i,j}$.

The display sub-pixels $\mathbf{16}_{i,j}$ may be formed on a first electronic circuit and the control circuits $\mathbf{14}_{i,j}$ and oscillating circuit OSC or oscillating circuits OSC may be formed on a second electronic circuit, the first and second electronic circuits being attached to each other. Control circuits $\mathbf{14}_{i,j}$ and oscillating circuit OSC or oscillating circuits OSC may be formed according to a CMOS technology. As a variation, control circuits $\mathbf{14}_{i,j}$ and oscillating circuit OSC or oscillating circuits OSC may be formed with thin-layer transistors.

Figure 3:
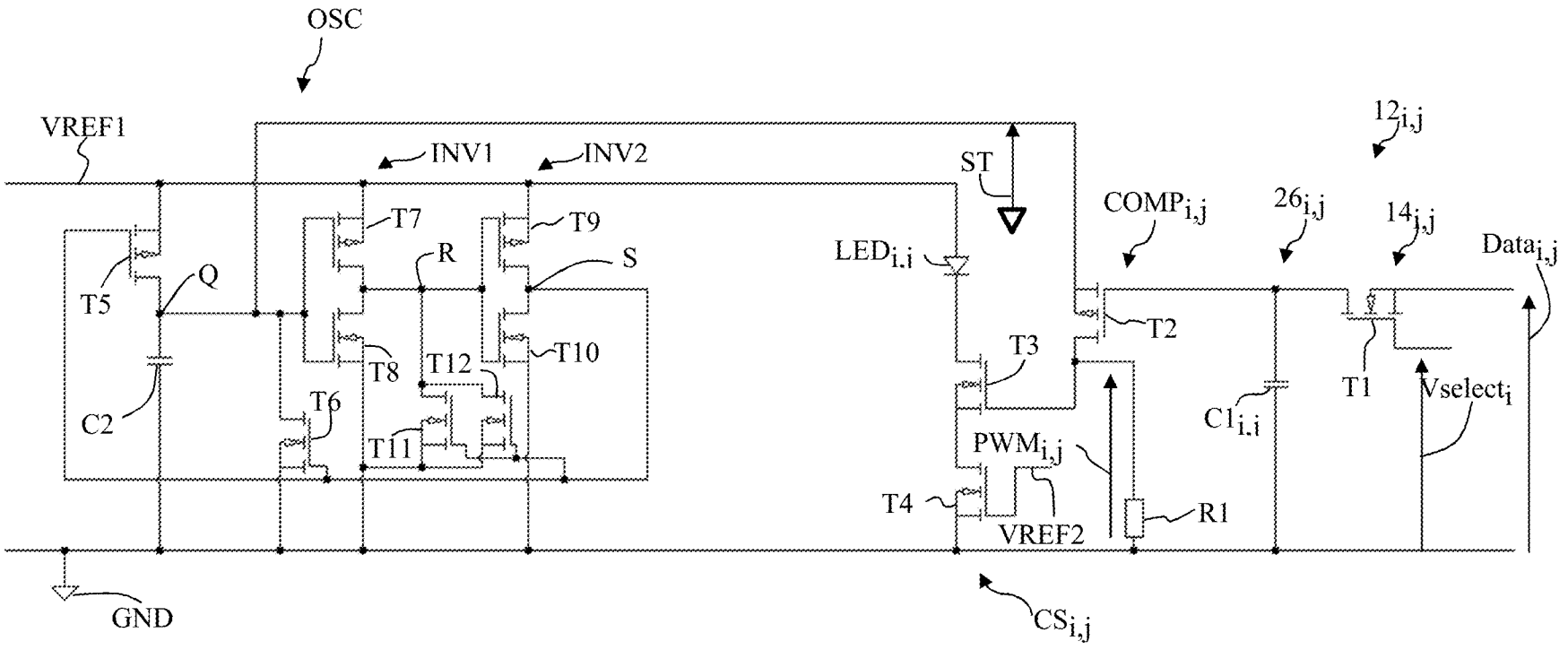
FIG. 3 shows an embodiment of an oscillating circuit and of a display circuit of the display screen of FIG. 1.

FIG. 3 shows an embodiment of an oscillating circuit OSC and of a display circuit $\mathbf{12}_{i,j}$ of display screen 10 of FIG. 1.

In the present embodiment, switch $SW_{i,j}$ of storage circuit $\mathbf{26}_{i,j}$ of control circuit $\mathbf{14}_{i,j}$ corresponds to a MOS transistor T1, for example, with an N channel, having its gate receiving signal $Vselect_i$, having its first power terminal receiving signal $Data_{i,j}$ and having its second power terminal coupled to a first electrode of capacitor $C\mathbf{1}_{i,j}$.

In the present embodiment, comparison circuit $COMP_{i,j}$ comprises a MOS transistor T2, for example, with a P channel, having its gate coupled to the first electrode of capacitor $C\mathbf{1}_{i,j}$, having its first power terminal receiving signal ST and having its second power terminal coupled to source GND of the low reference potential via a resistor R1. Signal $PWM_{i,j}$ supplied by comparison circuit $COMP_{i,j}$ corresponds to the voltage at the second power terminal of transistor T2.

In the present embodiment, controllable current source $CS_{i,j}$ comprises two series-connected MOS transistors T3 and T4, for example, with an N channel. The gate of transistor T3 is coupled to the second power terminal of transistor T2. The first power terminal of transistor T3 is coupled to the cathode of light-emitting diode $LED_{i,j}$ and the second power terminal of transistor T3 is coupled to the first power terminal of transistor T4. The gate of transistor T3 receives signal $PWM_{i,j}$. The anode of light-emitting diode $LED_{i,j}$ is coupled to a source VREF1 of a first high reference potential, for example, the power supply voltage of display screen 10. The gate of transistor T4 is coupled to a source VREF2 of a second high reference potential. The second power terminal of transistor T4 is coupled to source GND of the low reference potential.

In this embodiment, the controllable current source created by transistors T4 and T3 is designed to draw a current from the cathode of the LED to ground GND, the anode of the LED being connected to high power supply potential VREF1. This structure is particularly adapted to a LED technology where the equivalent electric representation of the pixels would be a common-anode structure. It will be within the abilities of those skilled in the art to easily modify the structure of the current source as well as of its control to adapt it to a LED/OLED technology where the electric representation would be a structure of common-cathode type or more generally a structure where the cathode of the LED would be connected to ground. The current source should then be placed between the anode of the LED and a high potential (VREF1 for example).

In the present embodiment, oscillating circuit OSC comprises a MOS transistor T5, for example, with a P channel, having a first power terminal coupled to source VREF1 of the first high reference potential and having its second power terminal coupled to a node Q supplying signal ST. Oscillating circuit OSC further comprises a capacitor C2 having its first electrode coupled to node Q and having its second electrode coupled to source GND of the low reference potential. Oscillating circuit OSC further comprises a MOS transistor T6, for example, with an N channel, having its first power terminal coupled to node Q and having its second power terminal coupled to source GND of the low reference potential. Oscillating circuit OSC further comprises a first inverter INV1 having its input coupled to node Q and having its output coupled to a node R. First inverter INV1 may comprise a MOS transistor T7, for example, with a P channel, series-connected with a MOS transistor T8, for example, with an N channel. The first power terminal of transistor T7 is coupled to source VREF1 of the first high reference potential and the second power terminal of transistor T7 is coupled to node R. The first power terminal of transistor T8 is coupled to node R and the second power terminal of transistor T8 is coupled to source GND of the low reference potential. The gates of transistors T7 and T8 are coupled to node Q. Oscillating circuit OSC further comprises a second inverter INV2 having its input coupled to node R and having its output coupled to a node S. Second inverter INV2 may comprise a MOS transistor T9, for example, with a P channel, series-connected with a MOS transistor T10, for example, with an N channel. The first power terminal of transistor T9 is coupled to source VREF1 of the first high reference potential and the second power terminal of transistor T9 is coupled to node S. The first power terminal of transistor T10 is coupled to node S and the second power terminal of transistor T10 is coupled to source GND of the low reference potential. The gates of transistors T9 and T10 are coupled to node S. Oscillating circuit OSC further comprises a MOS transistor T11, for example, with an N channel, having its first power terminal coupled to node R and having its second power terminal coupled to source GND of the low reference potential and a MOS transistor T12, for example, with an N channel, having its first power terminal coupled to node R and having its second power terminal coupled to source GND of the low reference potential. The gates of transistors T5, T6, T11, and T12 are coupled to node S.

According to an embodiment, source VREF1 of the first high reference potential is common to all the display circuits $12_{i,j}$ and the oscillating circuits OSC of display screen 10. According to an embodiment, source VREF2 of the second high reference potential is common to all the display circuits $12_{i,j}$ of display screen 10. According to another embodiment, display screen 10 comprises a plurality of sources VREF2 of the second high reference potential which are common to the display circuits $12_{i,j}$ emitting the same color. As an example, display screen 10 comprises a first source VREF2 of a second high reference potential for display circuits $12_{i,j}$ emitting red light, a second source VREF2 of the second high reference potential for display circuits $12_{i,j}$ emitting blue light, and a third source VREF2 of the second high reference potential for display circuits $12_{i,j}$ emitting green light. This particularly enables to vary the second high reference potentials differently according to the color of the light emitted by display circuits $12_{i,j}$. According to an embodiment, sources VREF1 and VREF2 may be confounded.

The embodiment of control circuit $14_{i,j}$ shown in FIG. 3 has the advantage that the structure of comparison circuit $COMP_{i,j}$ is particularly simple since it comprises a single MOS transistor.

Figure 4:
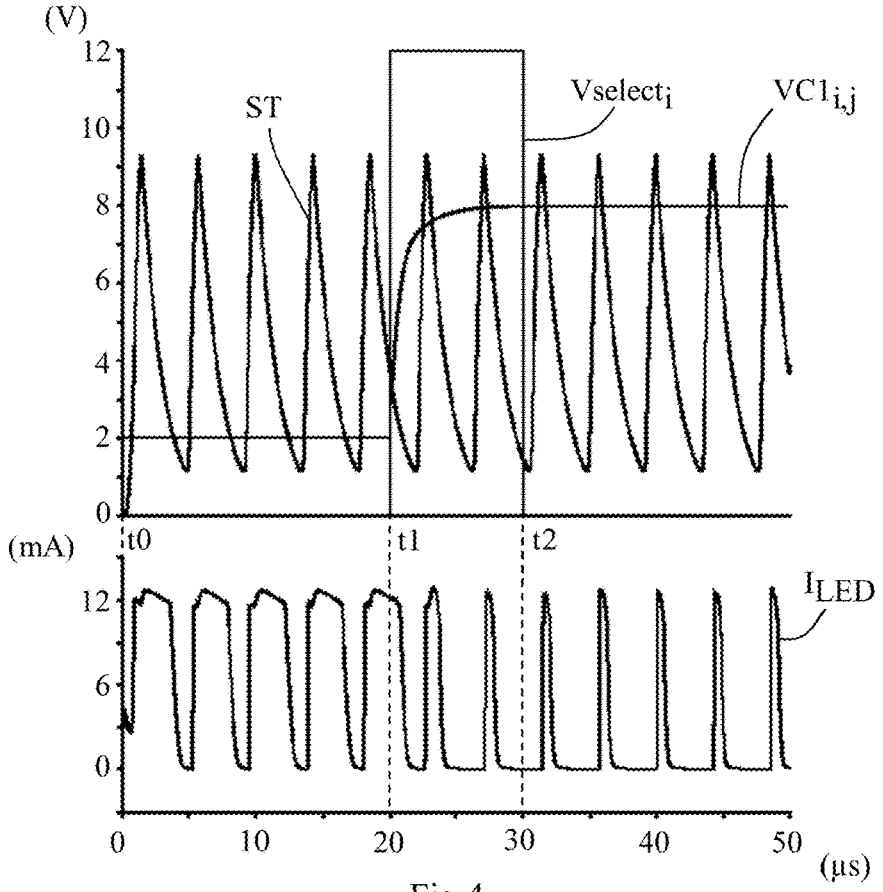
FIG. 4 shows a timing diagram of signals obtained during the operation of the oscillating circuit and of the display circuit shown in FIG. 3.

FIG. 4 shows a timing diagram obtained by simulations of voltages ST, $Vselect_i$, of voltage $VC1_{i,j}$ across capacitor $C1_{i,j}$ and of current $I_{LED}$ flowing through light-emitting diode $LED_{i,j}$ illustrating the operation of oscillating circuit OSC and of display circuit $12_{i,j}$ shown in FIG. 3. Times t0, t1, and t2 are successive. In the present example, the frequency of signal ST is 230 kHz and the display screen refreshment frequency is 20 ms. In the present example, signal $Vselect_i$ is in the low state (0 V) from time t0 to time t1. MOS transistor T1 is thus non-conductive and voltage $VC1_{i,j}$ across capacitor $C1_{i,j}$ is constant at a first level (2 V) corresponding to the last stored level of signal $Data_{i,j}$. From time t1 to time t2, signal $Vselect_i$ is in the high state (12 V). MOS transistor T1 is thus conductive and voltage $VC1_{i,j}$ across capacitor $C1_{i,j}$ varies to a second level (8 V) equal to $Data_{i,j}$ supplied to display circuit $12_{i,j}$. After time t2, signal $Vselect_i$ is in the low state. MOS transistor T1 is thus non-conductive and voltage $VC1_{i,j}$ across capacitor $C1_{i,j}$ remains constant at the second level.

Current $I_{LED}$ flowing through light-emitting diode $LED_{i,j}$ has substantially the shape of a square signal, alternating between a first level at approximately 12 mA and a second level at approximately 0 mA, which is periodic from time t0 to time t1 and after time t2, with a duty cycle, equal to the ratio of the duration at the first level to the duration of the period, which depends on voltage $VC1_{i,j}$. The first intensity level of current $I_{LED}$ is determined, in particular, by the level of the second high reference potential and the characteristics of transistor T4.

Oscillating circuit OSC supplies an oscillating and periodic signal ST, which preferably varies substantially monotonously over each period. An embodiment of oscillating circuit OSC is shown in FIG. 3. However, any type of oscillating circuit OSC capable of supplying a periodic oscillating signal ST, which preferably substantially monotonously varies over each period, may be used.

Figure 5:
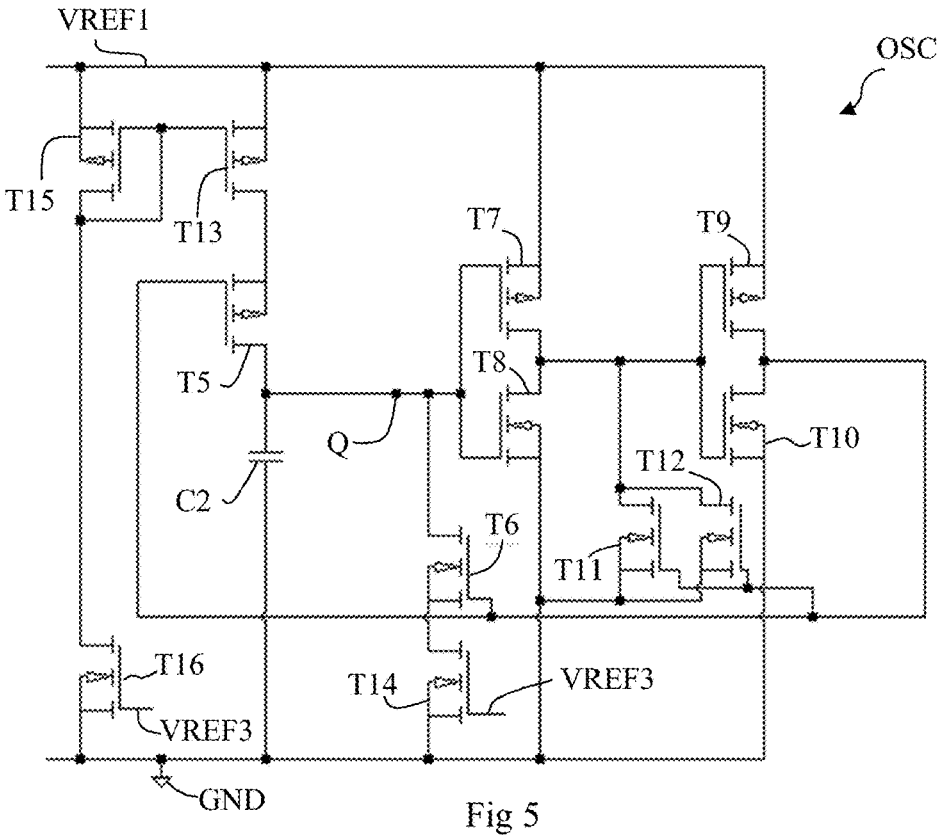
FIGS. 5 and 6 show other embodiments of the oscillating circuit of FIG. 2.

FIG. 5 shows another embodiment of oscillating circuit OSC.

The oscillating circuit OSC shown in FIG. 5 comprises all the elements of oscillating circuit OSC shown in FIG. 3 with the difference that transistor T5 is series-connected between a MOS transistor T13, for example, with a P channel, having its first power terminal coupled to source VREF1 of the first high reference potential and having its second power terminal coupled to the first power terminal of transistor T5 and with the difference that transistor T6 is series-assembled with a MOS transistor T14, for example, with an N channel, having its first power terminal coupled to the second power terminal of transistor T6, having its second power terminal coupled to source GND of the low reference potential, and having its gate coupled to a source VREF3 of a third high reference potential.

The oscillating circuit OSC shown in FIG. 5 further comprises a MOS transistor T15, for example, with a P channel, series-connected with a MOS transistor T16, for example, with an N channel. The first power terminal of transistor T15 is coupled to source VREF1 of the first high reference potential. The second power terminal of transistor T15 is coupled to the first power terminal of transistor T16 and the second power terminal of transistor T16 is coupled to source GND of the low reference potential. The gate of transistor T15 is coupled to the gate of transistor T13 and the gate of transistor T16 is coupled to source VREF3 of the third high reference potential.

The embodiment of the oscillating circuit OSC shown in FIG. 5 has the advantage of a better linearization of the charge and of the discharge of capacitor C2 with respect to the embodiment of the oscillating circuit OSC shown in FIG. 3.

Figure 6:
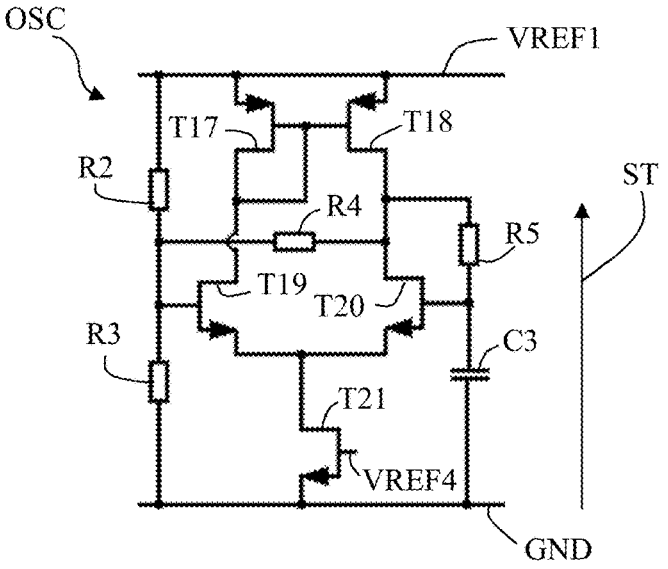

FIG. 6 shows another embodiment of oscillating circuit OSC.

The oscillating circuit OSC shown in FIG. 6 comprises two MOS transistors T17 and T18, for example, with a P channel, having their first power terminals coupled to source VREF1 of the first high reference potential and having their gates coupled to each other. The oscillating circuit OSC shown in FIG. 6 further comprises MOS transistors T19, T20, and T21, for example, with an N channel. The first power terminal of transistor T19 is coupled to the second power terminal of transistor T17 as well as to the gate of transistor T17. The first power terminal of transistor T20 is coupled to the second power terminal of transistor T18. The first power terminal of transistor T21 is coupled to the second power terminals of transistors T19 and T20. The second power terminal of transistor T21 is coupled to source GND of the low reference potential. The gate of transistor T21 is coupled to a source VREF4 of a fourth high reference potential. The oscillating circuit OSC shown in FIG. 6 further comprises four resistors R2, R3, R4, and R5. Resistor R2 is coupled between source VREF1 of the first high reference potential and the gate of transistor T19. Resistor R3 is coupled between the gate of transistor T19 and source GND of the low reference potential. Resistor R4 is coupled between the gate of transistor T19 and the first power terminal of transistor T20. Resistor R5 is coupled between the first power terminal of transistor T20 and the gate of transistor T20. The oscillating circuit OSC shown in FIG. 6 further comprises a capacitor C3 having its first electrode coupled to the gate of transistor T20 and having its second electrode coupled to source GND of the low reference potential. Oscillating signal ST for example corresponds to the voltage across the assembly formed by resistor R5 and capacitor C3. An advantage of the oscillating circuit OSC shown in FIG. 6 is that the switching times may be controlled with an increased accuracy.

Controllable current source $CS_{i,j}$ supplies, when it is activated, a substantially constant current which powers light-emitting diode $LED_{i,j}$. An embodiment of controllable current source $CS_{i,j}$ is shown in FIG. 3. However, any type of control-lable current source $CS_{i,j}$ and capable of supplying a substantially constant current which powers light-emitting diode $LED_{i,j}$ may be used.

Figure 7:
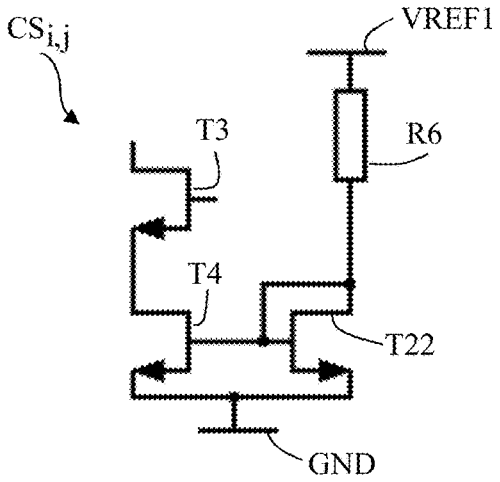
FIGS. 7 and 8 show other embodiments of the current source of the display circuit of FIG. 2.

FIG. 7 shows another embodiment of controllable current source $CS_{i,j}$.

The controllable current source $CS_{i,j}$ shown in FIG. 7 comprises all the elements of the controllable current source $CS_{i,j}$ shown in FIG. 3 with the difference that the gate of transistor T4 is coupled to the gate of a MOS transistor T22, for example with an N channel. The controllable current source $CS_{i,j}$ shown in FIG. 7 further comprises a resistor R6 having a terminal coupled to source VREF1 of the first high reference potential and having its second terminal coupled to the first power terminal of transistor T22. The second power terminal of transistor T22 is coupled to source GND of the low reference potential. The first power terminal of transistor T22 is further coupled to the gate of transistor T22. An advantage of the current source shown in FIG. 7 is that it does not require using source VREF2 of the second high reference potential. It can thus easily be formed at the level of display circuit $\mathbf{12}_{i,j}$.

Figure 8:
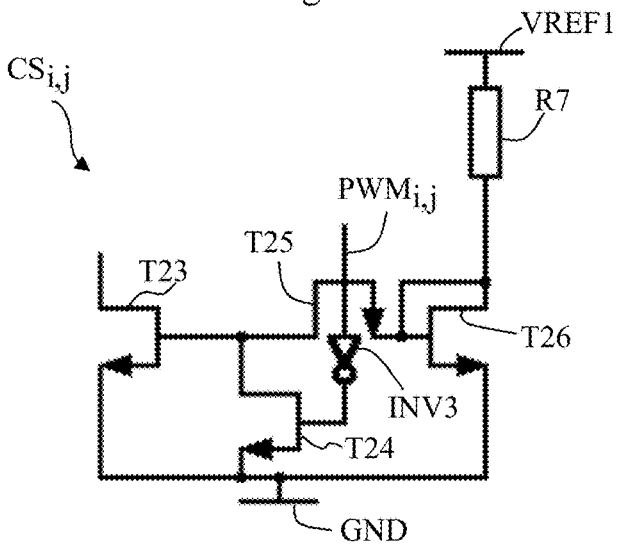

FIG. 8 shows another embodiment of controllable current source $CS_{i,j}$.

The controllable current source $CS_{i,j}$ shown in FIG. 8 comprises MOS transistors T23, T24, T25, and T26, for example, with an N channel. The first power terminal of transistor T23 is coupled to the cathode of light-emitting diode $LED_{i,j}$, not shown. The second power terminal of transistor T23 is coupled to source GND of the low reference potential. The first power terminal of transistor T24 is coupled to the gate of transistor T23. The second power terminal of transistor T24 is coupled to source GND of the low reference potential. The first power terminal of transistor T25 is coupled to the gate of transistor T23. The gate of transistor T25 receives signal $PWM_{i,j}$. The controllable current source $CS_{i,j}$ shown in FIG. 8 further comprises a resistor R7 having its terminal coupled to source VREF1 of the first high reference potential and having its second terminal coupled to the first power terminal of transistor T26. The second power terminal of transistor T26 is coupled to source GND of the low reference potential. The first power terminal of transistor T26 is further coupled to the gate of transistor T26. The gate of transistor T26 is coupled to the second power terminal of transistor T25. The controllable current source $CS_{i,j}$ shown in FIG. 8 further comprises an inverter INV3 having its input coupled to the gate of transistor T25 and having its output coupled to the gate of transistor T24.

Specific embodiments have been described. Various alterations and modifications will readily occur to those skilled in the art. Further, various embodiments with various variations have been described hereabove. It should be noted that various elements of these embodiments and variations may be combined. As an example, the embodiment of controllable current source $CS_{i,j}$ shown in FIG. 7 or 8 may be implemented with the oscillating circuit OSC shown in FIG. 5 or 6.

The invention claimed is:

1. A display screen comprising at least one thousand display circuits, each display circuit comprising a light-emitting diode, a controllable current source powering the light-emitting diode, and a control circuit capable of supplying a pulse-width modulated signal for controlling the current source from a periodic signal, the display screen further comprising first electrodes coupled to the control circuits, a circuit for supplying a selection signal successively on each first electrode, and oscillating circuits capable of supplying the periodic signals, the periodic signals being non-synchronous with the display circuit selection signals and being non-synchronous between them, such that rising and/or falling edges of a first signal among the periodic signals and the display circuit selection signals occur neither at a same time as rising and/or falling edges of a second signal among the periodic signals and the display circuit selection signals nor at regular intervals with respect to the rising and/or falling edges of the second signal, and wherein each oscillating circuit is coupled to less than one hundred of said control circuits.

2. The display screen of claim 1, wherein each of said at least two oscillating circuits is coupled to at least two of said control circuits.

3. The display screen of claim 1, wherein each of said at least two oscillating circuits is coupled to at least ten of said control circuits.

4. The display screen of claim 1, further comprising second electrodes coupled to the control circuits and a circuit for supplying data signals on the second electrodes and wherein the control circuit of each display circuit comprises a circuit for storing the data signal received by the control circuit and a circuit for comparing the data signal and the periodic signal capable of supplying the pulse-width modulated control signal.

5. The display screen of claim 1, wherein the frequency of each periodic signal is greater than twice the frequency of the selection signal on one of the first electrodes.

6. The display screen of claim 1, wherein the frequency of each periodic signal is greater than ten times the frequency of the selection signal on one of the first electrodes.

7. The display screen of claim 1, wherein the frequency of each periodic signal is smaller than 1 MHz.

* * * * *